US006010036A

United States Patent [19]

Bougamont et al.

[11] Patent Number: 6,010,036

[45] Date of Patent: Jan. 4, 2000

[54] DISPENSER FOR LIQUID OR PASTY MATERIALS

[75] Inventors: Jean-Louis Bougamont, Eu; Pierre Dumont, Houdain; Pierre Amiel, Neuilly-sur-Seine, all of France

[73] Assignee: SOFAB, France

[21] Appl. No.: 09/051,831

[22] PCT Filed: Oct. 23, 1996

[86] PCT No.: PCT/FR96/01656

§ 371 Date: Apr. 21, 1998

§ 102(e) Date: Apr. 21, 1998

[87] PCT Pub. No.: WO97/15509

PCT Pub. Date: May 1, 1997

[30] Foreign Application Priority Data

Oct. 23, 1995 [FR] France ..... 95 12432

[51] Int. Cl.[7] ..... B67D 5/06

[52] U.S. Cl. ..... 222/183; 222/321.4; 222/321.7; 222/340; 222/394

[58] Field of Search ..... 222/183, 321.4, 222/321.7, 321.8, 340, 383.1, 386, 494

[56] References Cited

U.S. PATENT DOCUMENTS

| | | | |
|---|---|---|---|
| 5,207,659 | 5/1993 | Pennaneac'h et al. | 222/494 |
| 5,267,673 | 12/1993 | Crosier et al. | 222/321.7 |
| 5,427,280 | 6/1995 | Fuchs | 222/386 |
| 5,620,113 | 4/1997 | Meshberg | 222/321.4 |
| 5,813,571 | 9/1998 | Gaucher | 222/321.7 |

*Primary Examiner*—Joseph A. Kaufman
*Attorney, Agent, or Firm*—Bacon & Thomas PLLC

[57] ABSTRACT

The invention provides a dispenser of substance in liquid or paste form, the dispenser being of the type comprising, in particular, a cylinder (1) of substance surmounted firstly by an endpiece (2) provided with an internal evacuation duct (2*a*) and fitted, secondly with a substance-taking system provided with an exhaust valve, the dispenser being characterized in that the substance-taking system comprises a piston (3) received in the cylinder (1) and having an axial duct (30) passing therethrough and connected to an outlet tube (4) whose bottom end (4*a*) cooperates with the axial duct (30) to define an admission orifice (40) and whose top end (4*b*) is secured to the endpiece (2) forming a pushbutton which bears directly or indirectly on the outside face (3*a*) of the piston (3) to put the cylinder (1) under pressure.

32 Claims, 7 Drawing Sheets

DISPENSER FOR LIQUID OR PASTY MATERIALS

BACKGROUND OF THE INVENTION

1. Field of the Invention

The present invention relates to a dispenser of substances in liquid or paste form.

2. Description of the Related Art

Dispensers are already in existence that comprise, in particular, a cylinder of substance surmounted firstly by an endpiece provided with an internal evacuation duct and fitted, secondly, with means for extracting the substance, and provided with an exhaust valve.

In general, the substance is taken from the cylinder by means of a pump that possesses an admission valve which co-operates with the exhaust valve to define a chamber inside the body of the pump.

The chamber is suitable for being put initially into suction to suck in substance from the cylinder, and then under pressure to expel said substance to the outside.

Unfortunately, such dispensers are relatively complex and therefore fragile insofar as they are constituted by a large number of parts.

Consequently, they are relatively expensive, thereby making them unattractive for use with samples.

In addition. beneath the pump body, the substance must fill the volume of the cylinder completely so as to avoid bubbles of air appearing subsequently and leading to faulty operation by loss of priming. Under such conditions, the various component elements are difficult to assemble.

SUMMARY OF THE INVENTION

An object of the present invention is to Solve the above technical and economic problems by providing a device in which the number of component parts is reduced and which is capable simultaneously of ensuring packaging that is simple and leakproof, and of dispensing the substance reliably.

According to the invention, this object is achieved by a dispenser of substance in liquid or paste form, the dispenser being of the type comprising, in particular, a cylinder of substance surmounted firstly by an endpiece provided with an internal evacuation duct and fitted, secondly with substance-taking means provided with an exhaust valve, the dispenser being characterized in that said substance-taking means comprise a piston received in the cylinder and having an axial duct passing therethrough and connected to an outlet tube whose bottom end co-operates with said axial duct to define an admission orifice and whose top end is secured to said endpiece forming a pushbutton which bear; directly or indirectly on the outside face of the piston to put the cylinder under pressure.

According to an advantageous characteristic, the outside face of said piston includes a bush co-operating with the internal side wall of the cylinder to define a peripheral space in which the bottom side portion of the endpiece is engaged.

According to another characteristic, the top edge of the cylinder is provided with a shoulder under which a peripheral flange formed on the bottom side edge of the endpiece is engaged.

According to yet another characteristic, said endpiece is constituted firstly by a dispenser head provided with said internal evacuation duct communicating at its bottom end with the outlet tube and extending, secondly, towards the cylinder by means of a lateral skirt.

Preferably, the cylinder is provided with an internal lateral jacket.

In addition, provision is made for the dispenser to include a removable cap designed to cover the endpiece. The cap is engaged telescopically on the top portion of the internal jacket, being flush with the outside wall of the cylinder. Its internal side wall is also provided with a longitudinal groove forming a vent.

In a first embodiment, said endpiece is axially movable relative to the piston, being urged away therefrom by a spring bearing against the outside face of the piston.

The outlet tube is then formed by a hollow rod slidably engaged in the axial duct and having its bottom end projecting into the cylinder regardless of the position of the endpiece.

In this embodiment, the bottom end of the outlet tube is closed by a solid base of larger section designed to bear in sealed manner against the internal rim of the axial duct when the endpiece is being returned, thereby forming the exhaust valve.

In addition, said admission orifice opens out sideways at the bottom end of the outlet tube on either side of its central axis.

In a second embodiment, said axial duct is terminated at its outer end by a hemispherical cap pierced by a central ejection orifice having elastically deformable edges designed to be closed in a closure position by an axial finger secured to the endpiece and forming the exhaust valve.

In which case, the outlet tube is engaged on the axial duct and has its bottom edge bearing against the outside face of the piston.

In another embodiment, the outlet tube is engaged in the axial duct and bears via a peripheral shoulder on the outside face of the piston.

In this embodiment, the internal evacuation duct of the endpiece is provided with the exhaust valve constituted by a rod carrying firstly at its outer end a cup whose lateral flank forms an elastically deformable peripheral lip and secondly, at its inner end, a spider for fixing it in said evacuation duct.

In all of the embodiments envisaged, provision is made for said piston to have a substantially bell-shaped section with a peripheral lip bearing in sealed manner against the 'inside wall of the cylinder.

Where appropriate, the axial duct of the piston projects into the cylinder and the bottom of the cylinder is complementary in profile to the inside face of the piston to ensure complete evacuation of the substance.

The invention also provides a method of packaging substance inside the above dispenser, characterized in that the cylinder is filled with the substance, and in parallel the closure and substance-taking system is assembled by fixing the endpiece on the piston together with the intermediate spring, where appropriate, by inserting the assembly thus constituted into the jacket until the flange of the endpiece comes into inside abutment against the shoulder of the jacket, and by covering the endpiece with the cap, and then the closure and substance-taking system is assembled on the cylinder by making the jacket slide in contact with the inside wall of the cylinder with radial clamping.

The dispenser of the invention makes it possible simultaneously to package the substance in entirely leakproof manner and to eject it reliably using means that are technically simple and therefore of low cost.

In addition, the dispenser presents no risk of becoming unprimed since it is the cylinder itself that is put under pressure. Substance is taken at user request, and continuously without the substance being measured out in any way. The quantity of substance dispensed therefore depends on the duration and on the force of pressure applied to the pushbutton-forming endpiece.

The compact appearance makes the dispenser very attractive and well adapted to use for packaging samples of cosmetics or of pharmaceutical substances.

The presence of a jacket inside the cylinder also makes assembly and filling easy at the packaging stage.

BRIEF DESCRIPTION OF THE DRAWINGS

The invention will be better understood on reading the following description accompanied by the drawings, in which.

DETAILED DESCRIPTION OF THE PREFERRED EMBODIMENTS

Figure 1A:
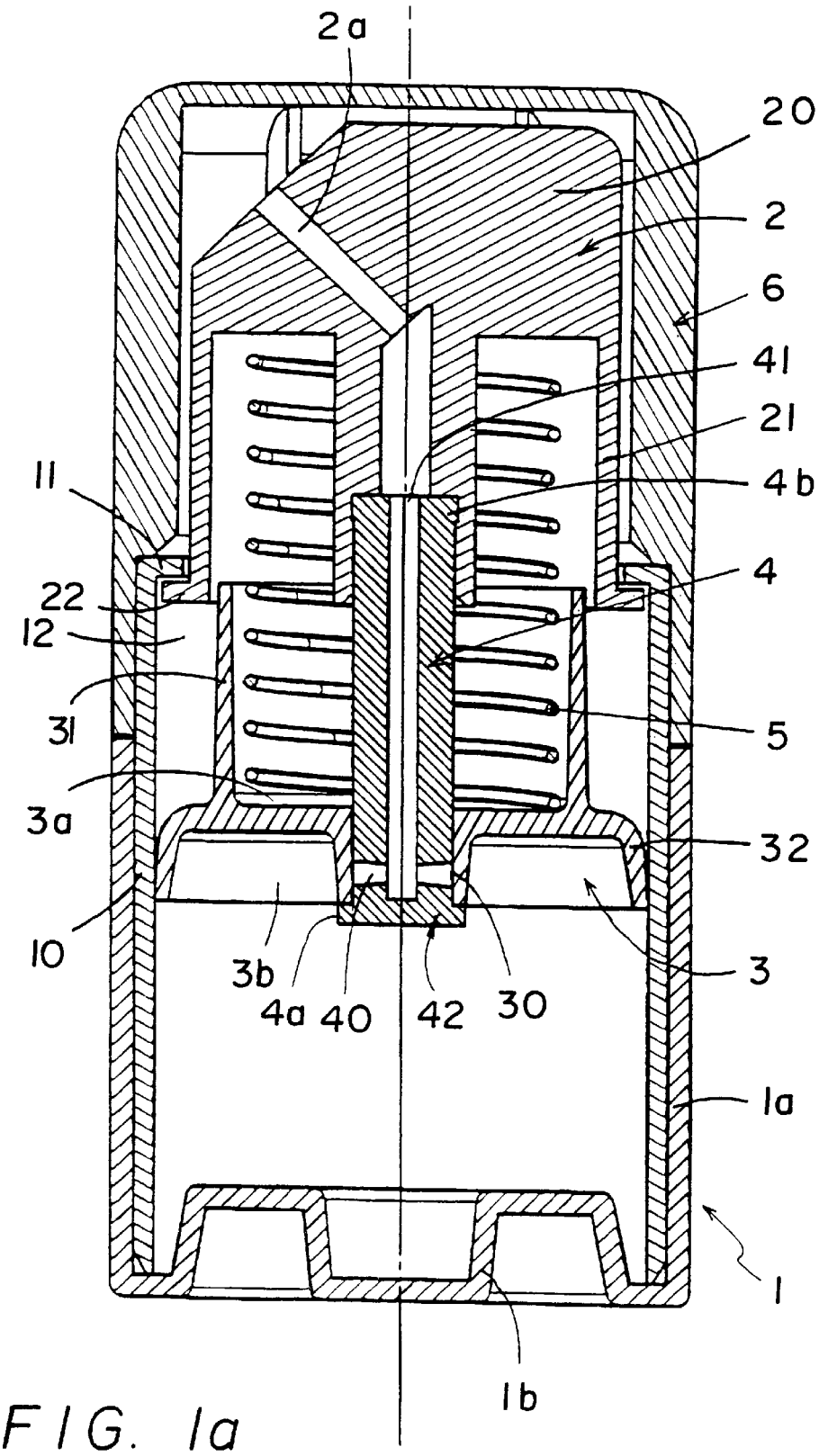
FIGS. 1*a* and 1*b* are cross-section views through two variants of a first embodiment of the dispenser of the invention.
Figure 1B:
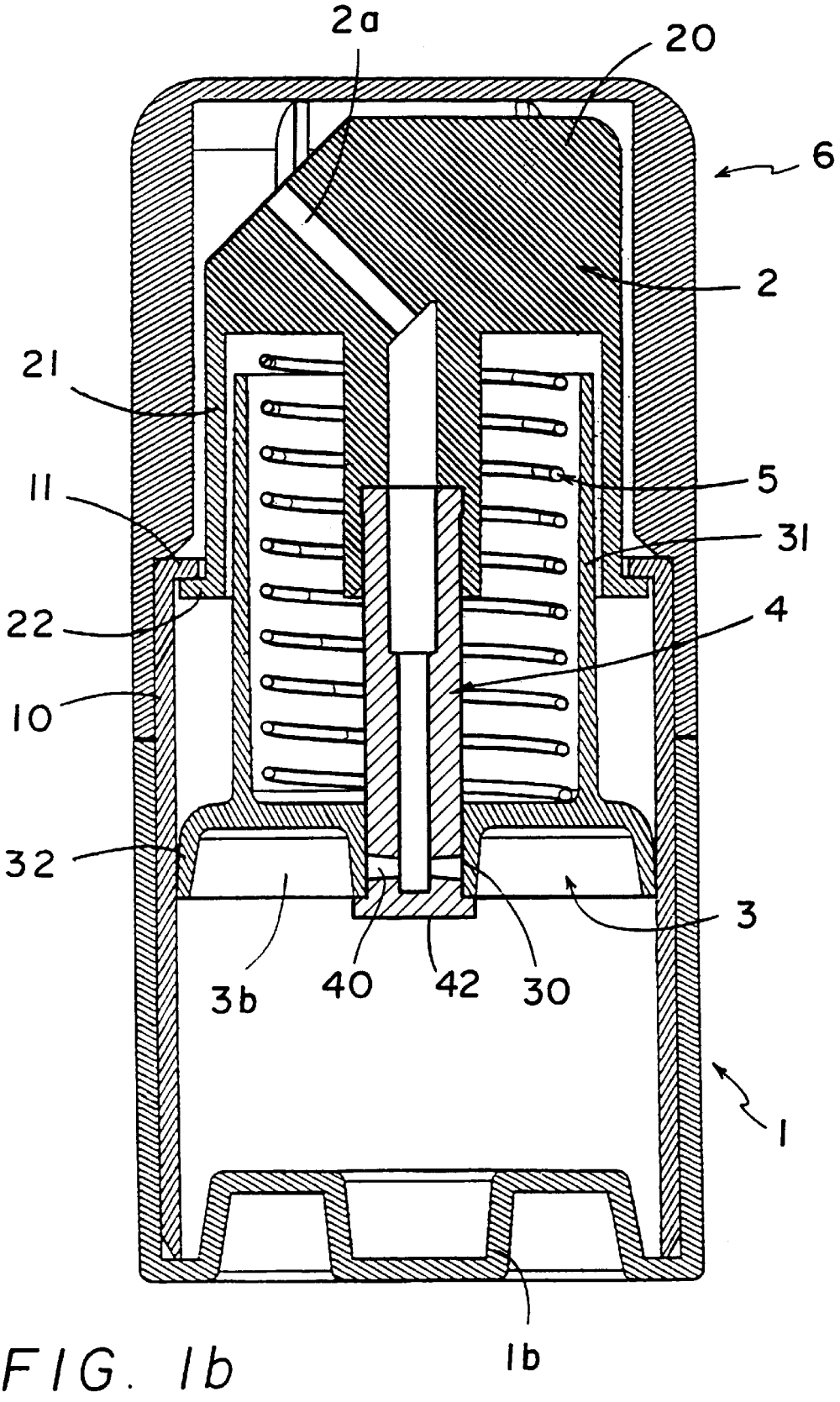

The dispenser shown in FIGS. 1*a* and 1*b* has a cylinder 1 for the substance. The cylinder 1 is surmounted by an endpiece 2 which is provided with an internal evacuation duct 2*a*.

The means for taking substance from the cylinder 1 comprise, in particular, a piston 3 housed inside the cylinder 1. The piston 3 has an axial duct 30 passing therethrough connected to an outlet tube 4 which, in this embodiment, is constituted by a hollow rod. The piston 3 can be moved axially inside the cylinder 1 by pressing on the endpiece 2.

The bottom end 4*a* of the tube 4 co-operates with the axial duct 30 to define an admission orifice 40, while the top end 4*b* thereof is provided with an ejection orifice 41 and is secured to the endpiece 2. The bottom end 4*a* of the outlet tube 4 is closed by a solid base 42 of section larger than that of the axial duct 30. The base 42 is designed, on closure, to bear in leakproof manner against the internal rim of the axial duct 30, thus Constituting the exhaust valve.

The cylinder 1 is provided with an internal side jacket 10 that is radially compressed. The axial duct 30 projects into the cylinder 1, and the bottom 1*b* of the cylinder is of a profile that is complementary to that of the inside face 3*b* of the piston 3 so as to ensure that the substance is completely evacuated. The piston 3 is preferably substantially bell-shaped in section with a peripheral lip 32 folded towards the inside of the cylinder 1 and bearing in leakproof manner against its inside wall or against the inside wall of the jacket 10.

By pressing on the endpiece 2, the piston 2 is caused to slide into the cylinder 1 continuously and at uniform speed. This displacement is accompanied by the inside wall of the cylinder 1 or of the jacket 10 being scraped by the lip 32.

The endpiece 2 thus forms a manual pushbutton which bears, in this case via a spring 5, on the outside face 3*a* of the piston 3 to put the reservoir 1 under pressure. The endpiece 1 is constituted firstly by a dispensing head 20 provided with an internal evacuation duct 2*a* which communicates at its bottom end with the ejection orifice from the outlet tube 4.

The head 20 is extended towards the cylinder by a lateral skirt 21 whose bottom edge is provided with a peripheral flange 22.

The dispenser also includes a removable cap 6 for covering the endpiece 2.

The cap 6 is engaged telescopically on the top portion of the jacket 10, being flush with the outside wall of the cylinder 1. The inside wall of the endpiece is provided with a longitudinal groove 9 that forms a vent while the substance is being packaged (see FIG. 6*c*).

In this case, the endpiece 2 is movable axially relative to the piston 3, being urged away therefrom in an upwards direction by the spring 5.

The outside face 3*a* of the piston 3 includes a bush 31 which co-operates with the inside wall 1*a* of the cylinder or of the jacket 10 to define a peripheral space 12 in which the bottom side portion of the endpiece 2 and in particular the bottom edge of the skirt 21 is engaged.

In this particular embodiment, the spring 5 is received in and held in the bush 31, surrounding the outlet tube 4 coaxially.

The top edge of the jacket 10 (or where appropriate of the cylinder 1) is provided with a shoulder 11 under which the peripheral flange 22 formed on the bottom side edge of the endpiece 2 is retained.

Figures 5A, 5B, 5C:
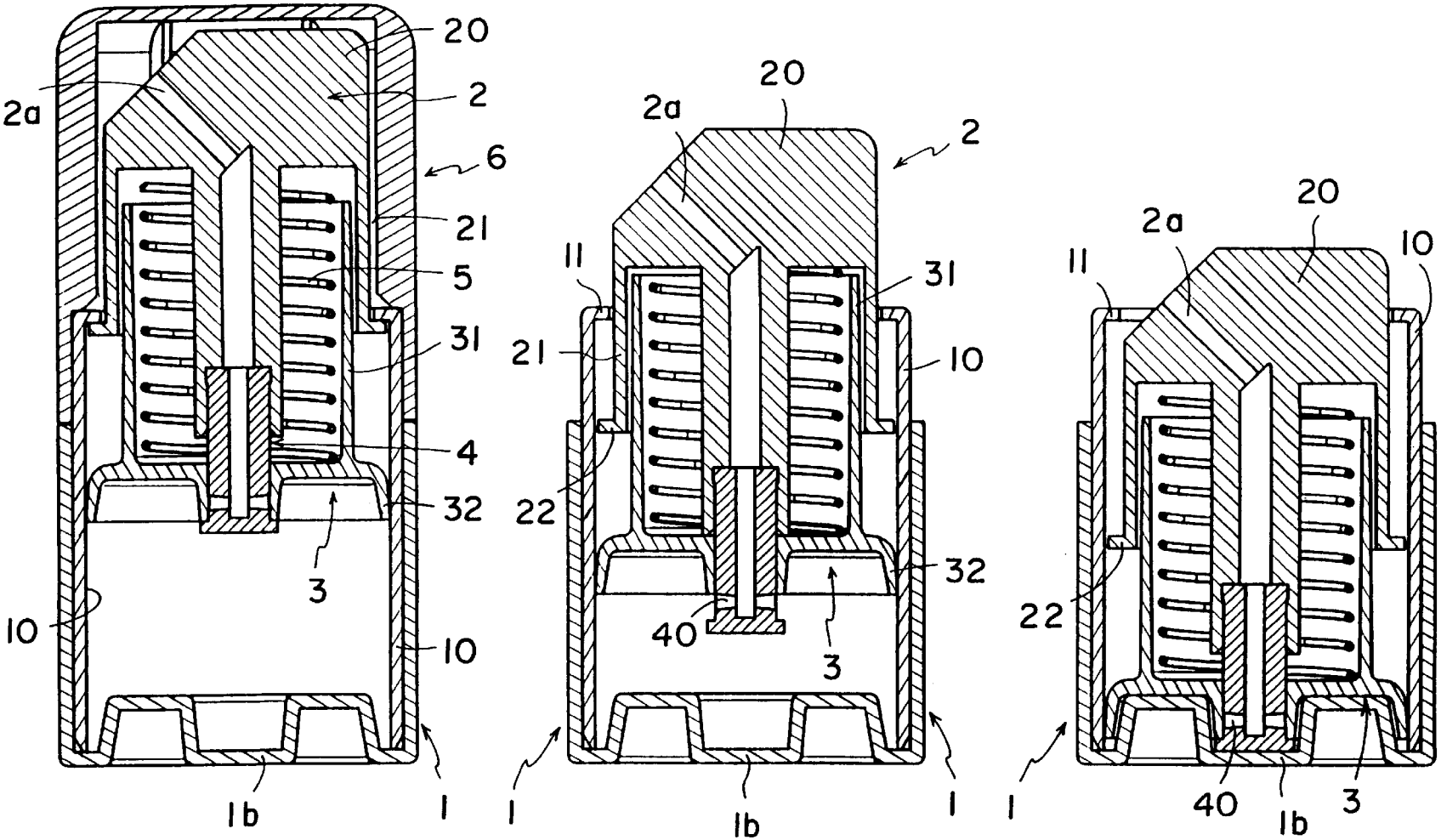
FIGS. 5*a*, 5*b*, and 5*c* are cross-section views of a dispenser of the invention in operation.

As shown in FIGS. 5*a* to 5*c*, when the spring 5 is compressed, the flange 22 moves in the peripheral space 12, being guided by the respective walls of the bush 31 and of the jacket 10 until it optionally comes into downward abutment against the edge of the outside face 3*a* of the piston 3.

While this compression is taking place, the outlet tube 4 slides in the axial duct 30 to release the admission orifice 40 carried by its bottom end 4*a* and opening out sideways from the tube 4 on either side of the central axis. When the spring 5 reaches a particular level of compression (as a function of its stiffness) and if the manual force continues to be applied, then the force is transmitted indirectly via the spring 5 to the piston 3 which then moves downwards to compress the substance. On being compressed, the substance escapes via the admission orifice 40 and then via the outlet tube 4 to the evacuation duct 2*a*. When the endpiece 2 is released, the spring 5 returns it upwards, so that it entrains the outlet tube 4 as it rises and causes the base 42 to press in sealed manner against the internal bottom edge of the axial duct 30. This configuration with indirect thrust on the piston 3 makes it possible to obtain controlled evacuation of the substance.

The cylinder 1 is then closed again and the substance is isolated from the outside.

In a variant shown in FIG. 1*b*, the respective heights of the skirt 21 and of the bush 31, and also the stiffness of the spring 5 are determined relative to one another so that the top edge of the bush 31 on the piston 3 comes into abutment directly against the head 20 of the endpiece 2, or else, in another variant (not shown), the bottom edge of the skirt 21 comes into abutment directly against the outside face 3*a* of the piston 3 before the spring 5 has reached its particular degree of compression. This configuration with direct abutment against the piston 3 limits the stroke of the endpiece 2 and leads to the substance being evacuated more cleanly.

The bottom end of the outlet tube 4, constituted by the base 42, continues to project into the inside of the cylinder 1, regardless of the relative positions of the endpiece 2 and of the spring 5.

The cylinder 1 and its jacket 10 can be made of transparent material so as to enable the level of substance remaining to be observed continuously. During successive operations of dispensing the substance, the endpiece 2 moves into the cylinder 1 without any possibility of returning to its initial position.

This makes it possible to put graduations on the skirt 21 so that the top edge of the jacket 10 or of the cylinder marks at all times, on said graduations, the volume that retains in the dispenser and that corresponds to a given depression of the endpiece 2 into the cylinder 1.

Figure 2:
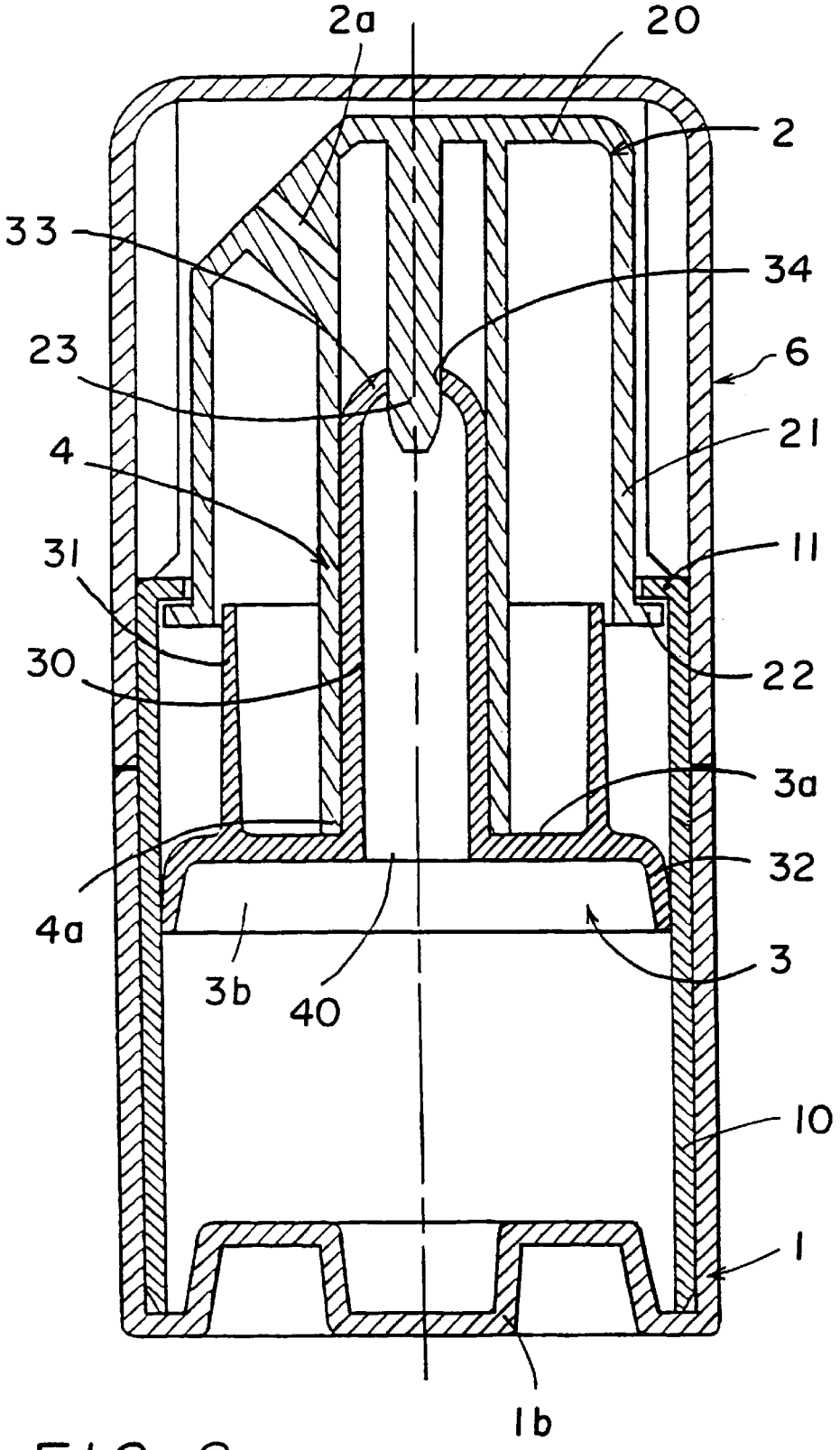
FIG. 2 is a cross-section view through a second embodiment of the dispenser of the invention.

The dispenser shown in FIG. 2 corresponds to a second embodiment in which the endpiece 2 is fixed relative to the piston 3.

In this case, the outlet tube 4 is integral with the endpiece 2 and has its bottom edge 4*a* bearing directly against the outside face 3*a* of the piston 3, said tube being engaged on the axial duct 30.

The axial duct 30 extends outside the cylinder 1 beyond the outside face 3*a* of the piston 3 and its top outermost end is terminated by a hemispherical cap 33.

The cap is pierced axially by a central ejection orifice 34 having elastically deformable edges.

When the cap 33, and possibly a portion of the duct 30, are formed integrally out of a flexible and elastically deformable material, the rigid tube 4 makes it possible to hold said duct axially.

The ejection orifice 34 is designed to be closed in a closure position by an axial finger 23 secured to the endpiece 2 and extending towards the piston 3, being connected to the dispenser head 20.

The exhaust valve of the dispenser is formed by co-operation between the axial finger 23 and the spherical cap 33 together with its ejection orifice 34.

By pressing on the head 20 of the endpiece 2, the user pushes down the piston 3 which then compresses the substance. The substance fills the axial duct 30 inside the tube 4 before escaping under the effect of the pressure around the finger 23 towards the duct 2*a* by elastically deforming the outline of the ejection orifice 34. When pressure ceases to be applied, the edges of the ejection orifice 34 automatically close in sealed manner around the finger 23.

Figure 3:
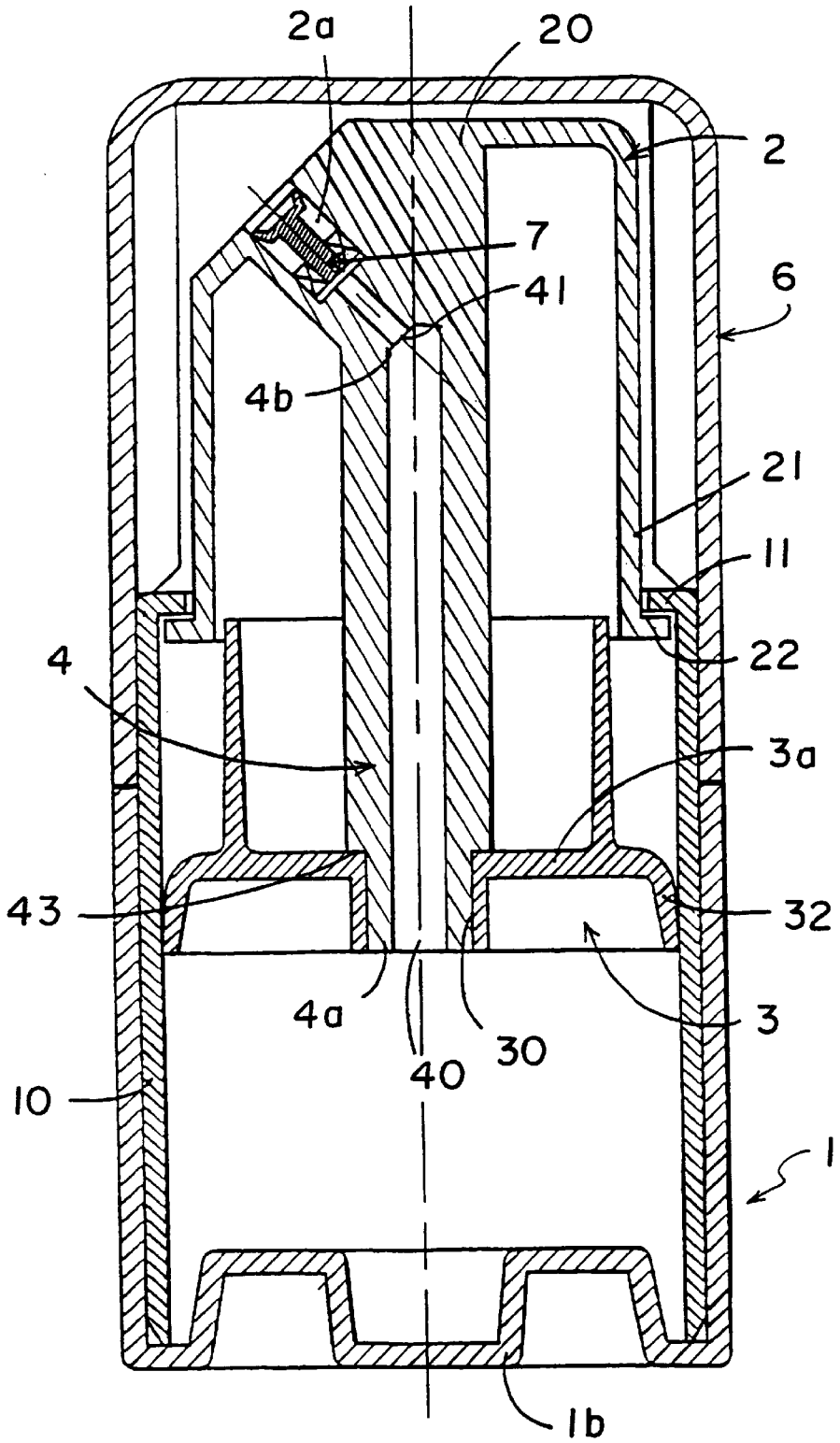
FIG. 3 is a cross-section view through a third embodiment of a dispenser of the invention.

The dispenser shown in FIG. 3 corresponds to a third embodiment in which the endpiece 2 is still fixed relative to the piston 3. The outlet tube 4 is integral with the endpiece 2, being secured to the dispenser head 20. The tube 4 is connected to the axial duct 30 of the piston 3 by sealed mutual engagement inside the duct 30 and it has a peripheral shoulder 43 bearing against the outside face 3*a* of the piston 3 via a shoulder in said duct 30.

The ejection orifice 41 of the tube 4 is located at the junction with the internal evacuation duct 2*a* of the endpiece 2.

The admission orifice 40 is at the bottom end 4*a* of the tube 4 and its section is smaller than that of the axial duct 30 because of the mutual engagement.

The exhaust valve 7 is constituted in this case by an independent element disposed in an enlarged housing 27 formed in the internal evacuation duct 2*a* of the endpiece 2.

Figure 4:
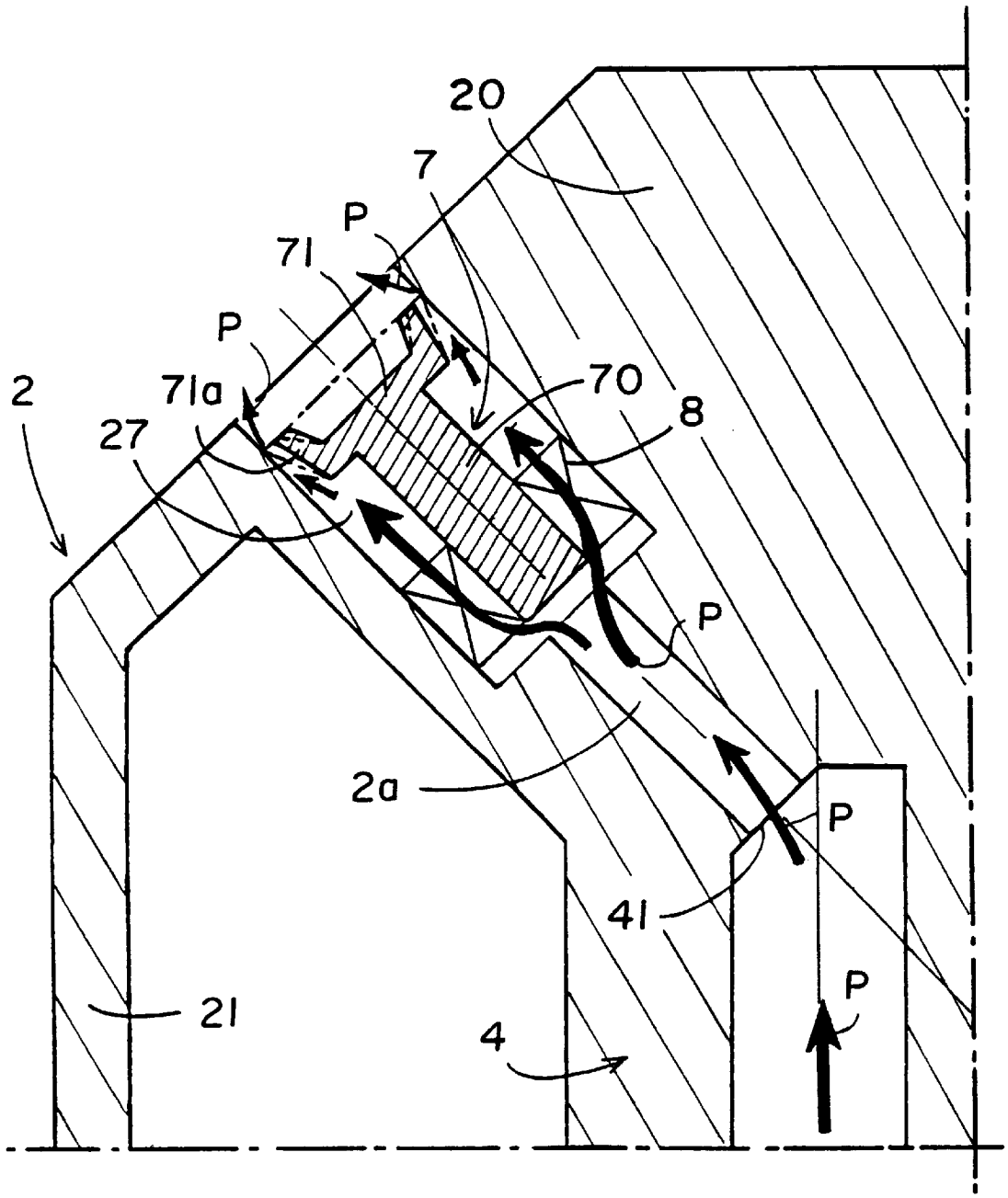
FIG. 4 is a detail section view of the FIG. 3 dispenser.

As shown in FIG. 4, the valve is constituted by a rod 70 carrying a cup 71 at its outer end, with the side wall 71*a* thereof that extends towards the outlet of the duct 2*a* forming an elastically deformable peripheral lip that bears in sealed manner in a closed position against the wall of the housing 27 (shown in chain-dotted lines in the figure). The valve member 7 is retained in the housing 27 by means of a peripheral spider 8 fixed around the inside end of the rod 70 and secured to the inside wall of said housing. When the cylinder 1 is put under pressure by pressing on the dispenser head 20. the substance escapes in the direction of arrow P via the ejection orifice 41 of the outlet tube 4, penetrates into the internal evacuation duct 2*a*, and then into the housing 27 passing through the spider 8, around the rod 70. Thereafter the substance elastically deforms the peripheral lip 71 to open up a lateral outlet passage to the outside as shown by solid lines in FIG. 4. When pressure ceases to be applied. the lip 71*a* returns elastically to a sealing position inside the housing 27.

The method of packaging a substance P in a dispenser of the invention is described below with reference to FIGS. 6*a* to 6*d*.

Figures 6A, 6B, 6C, 6D:
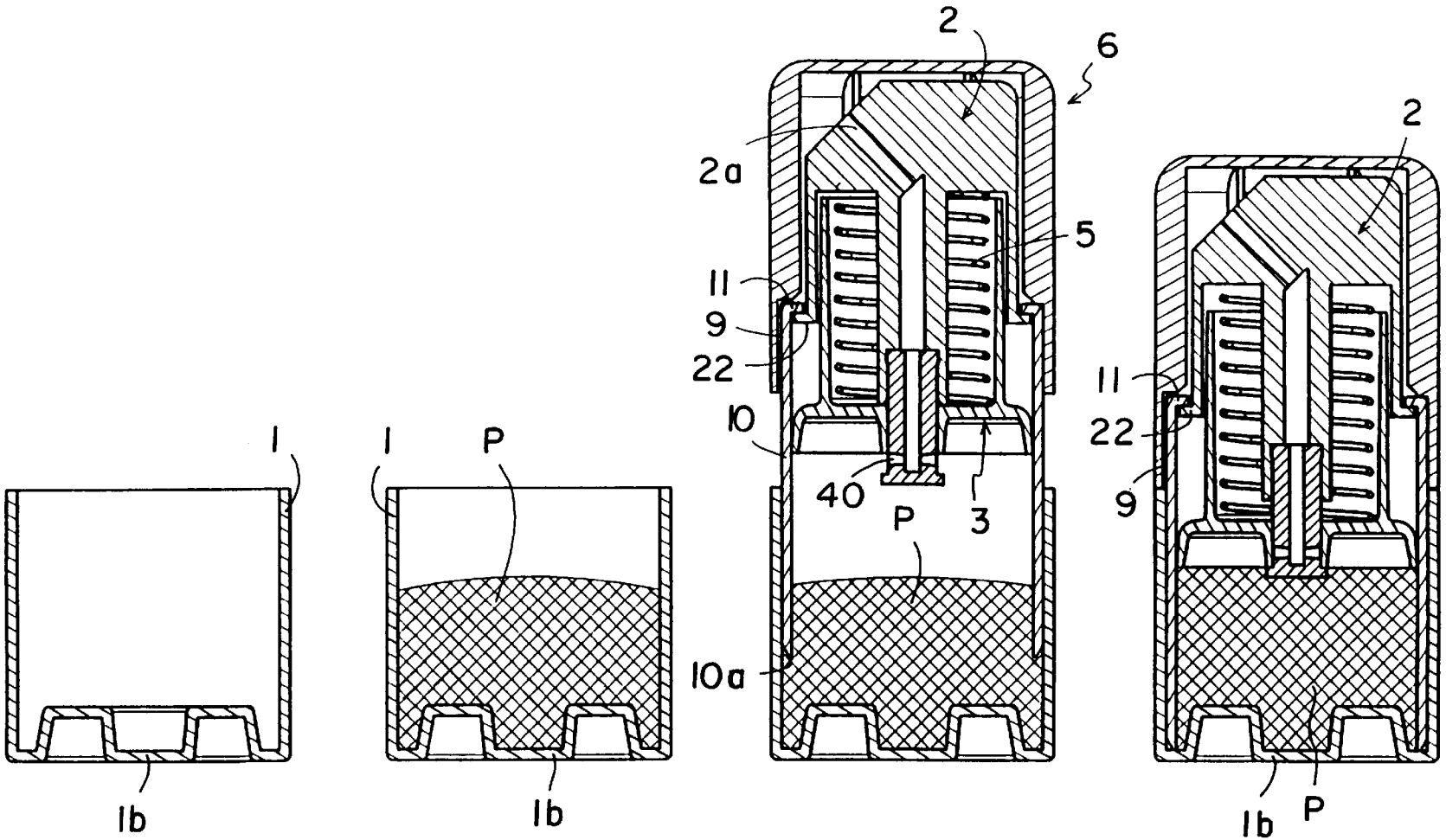
FIGS. 6*a*, 6*b*, 6*c*, and 6*d* are cross-section views of the component elements of the dispenser of the invention during packaging of the substance.

As shown in FIGS. 6*a* to 6*d*, the dispenser of the invention is provided in the form of two components that are to be assembled together while packaging the substance P. The first component is constituted by the cylinder 1 itself (FIG. 6*a*). The second component is constituted by the closure and substance-taking system comprising the endpiece 2 covered firstly by the fixed cap 6 and secondly by the piston 3, optionally including the intermediate spring 5, and also fitted with the jacket 10. The piston 3 secured to the endpiece is previously inserted into the jacket 10 via its bottom opening. During this operation, the lip 32 of the piston 3 pointing in the opposite direction to the insertion direction slides along the inside wall of the jacket 10 without being damaged until the flange 22 comes into abutment on the inside against the shoulder 11.

Thereafter, while the components for assembly during packaging are being transported and handled. the lip continues to be protected by the jacket 10.

After the cylinder 1 has been filled with substance (FIG. 6*b*), the closure and substance-taking system is mounted on said cylinder by applying pressure directly onto the cap 6 (FIG. 6*c*). The internal jacket 10 then slides inside the cylinder 1, in compressed contact against its inside wall until its bottom edge 10*a* comes into abutment against the bottom 1*b* (FIG. 6*d*) or, in a variant (not shown) against a shoulder provided for this purpose. Assembly can be performed either under a vacuum, or in air, in which case compressed air escapes via the exhaust valve and then via the vent 9 in the cap 6. Under such circumstances. it is advisable to avoid filling the cylinder 1 completely. Final clamping between the jacket 10 and the cylinder 1 must be sufficient to ensure that the components are definitively secured one to the other, and it must also be tighter than the clamping between the clip 6 and the endpiece so that removing the cap does not cause the jacket 10 to be removed from the cylinder 1.

We claim:

1. A dispenser of substance in liquid or paste form, the dispenser being of the type comprising, in particular, a cylinder (1) of substance surmounted firstly by an endpiece (2) provided with an internal evacuation duct (2*a*) and fitted, secondly with substance-taking means comprising:

a piston (3) received in the cylinder (1) and having an axial duct (30) passing therethrough and connected to an outlet tube (4) whose top end (4*b*) is secured to said endpiece (2) forming a pushbutton which bears on the outside face (3*a*) of the piston (3) to put the cylinder (1) under pressure;

an admission orifice (40) defined by the axial duct (30); and a removable exhaust valve, the dispenser being characterized in that the cylinder (1) is provided with an internal lateral jacket (10) and in that the top edge of the jacket (10) is provided with a shoulder (11) under which a peripheral flange (22) formed on the bottom side edge of the endpiece (2) is engaged.

2. A dispenser according to claim 1, characterized in that the outside face (3*a*) of the piston (3) includes a bush (31) cooperating with the internal side wall of the cylinder (1) to define a peripheral space (12) in which the bottom side portion of the endpiece (2) is engaged.

3. A dispenser according to claim 1, characterized in that the endpiece (2) is constituted firstly by a disperser head (20) provided with the internal evacuation duct (2*a*) communicating at its bottom end with the outlet tube (4) and extending, secondly, towards the cylinder (1) by a lateral skirt (21).

4. A dispenser according to claim 1, characterized in that it includes a removable cap (6) for covering the endpiece (2) and having an internal side wall which is provided with a vent-forming groove (9).

5. A dispenser according to claim 4, characterized in that the cap (6) is engaged telescopically on the top portion of the internal jacket (10), being flush with the outside wall (1*a*) of the cylinder (1).

6. A dispenser according to claim 1, characterized in that the axial duct (30) of the piston (3) projects into the cylinder (1) and the bottom (1*b*) of the cylinder (1) is complementary in profile to the inside face (3*b*) of the piston (3) to ensure complete evacuation of the substance.

7. A dispenser according to claim 1, characterized in that the endpiece (2) is axially movable relative to the piston (3), being urged away therefrom by a spring (5) bearing against the outside face (3*a*) of the piston.

8. A dispenser according to claim 7, characterized in that the outlet tube (4) is then formed by a hollow rod slidably engaged in the axial duct (30) and having its bottom end (4*a*) projecting into the cylinder (1) regardless of the position of the endpiece (2).

9. A dispenser according to claim 7, characterized in that the bottom end (4*a*) of the outlet tube (4) is closed by a solid base (42) of larger section designed to bear in a sealed manner against the internal rim of the axial duct (30) when the endpiece (2) is being returned, thereby forming the exhaust valve.

10. A dispenser according to claim 7, characterized in that the admission orifice (40) opens out sideways at the bottom end (4*a*) of the outlet tube (4) on either side of its central axis.

11. A dispenser according to claim 1, characterized in that the axial duct (30) is terminated at its outer end by a hemispherical cap (30) pierced by a central ejection orifice (34) having elastically deformable edges designed to be closed in a closure position by an axial finger (23) secured to the endpiece (2) and forming the exhaust valve.

12. A dispenser according to claim 11, characterized in that the outlet tube (4) is engaged on the axial duct (30) and has its bottom edge (4*a*) bearing against the outside face (3*a*) of the piston (3).

13. A dispenser according to claim 1, characterized in that the outlet tube (4) is engaged in the axial duct (30) and bears via a peripheral shoulder (43) on the outside face (3*a*) of the piston (3).

14. A dispenser according to claim 13, characterized in that the internal evacuation duct (2*a*) of the endpiece (2) is provided with the exhaust valve (7) constituted by a rod (70) carrying firstly at its outer end a cup (71) whose lateral flank forms an elastically deformable peripheral lip (71*a*) and secondly, at its inner end, a spider (8) for fixing it in the evacuation duct (2*a*).

15. A dispenser according to claim 1, characterized in that the piston (3) is of substantially bell-shaped section with a peripheral lip (32) bearing in a sealed manner against the inside wall of the cylinder (1).

16. A method of packaging a substance in liquid or paste form in a dispenser, the method comprising the steps of:

filling a cylinder (1) with a substance (P);

assembling a closure and substance-taking system by fixing an endpiece (2) on a piston (3) to constitute an assembly, inserting the assembly into a jacket (10) until a flange (22) of the endpiece (2) comes into inside abutment against a shoulder (11) of the jacket (10) and covering the endpiece (2) with a cap (6); and after filling the cylinder (1) and assembling the closure and substance-taking system, assembling the closure and substance-taking system on the cylinder (1) by making the jacket (10) slide in contact with an inside wall of the cylinder (1) with radial clamping.

17. The method according to claim 16, wherein the step of assembling the closure and substance-taking system further comprises:

fixing the endpiece (2) on the piston (3) together with an intermediate spring (5).

18. A dispenser of substance in liquid oar paste form, the dispenser being of the type comprising, in particular, a cylinder (1) of substance surmounted firstly by an endpiece (2) provided with an internal evacuation duct (2*a*) and fitted, secondly with substance-taking means comprising:

a piston (3) received in the cylinder (1) and having an axial duct (30) passing therethrough and connected to an outlet tube (4)whose top end (4*b*) is secured to said endpiece (2) forming a pushbutton which bears on the outside face (3*a*) of the piston (3) to put the cylinder (1) under pressure;

an admission orifice (40) defined by the bottom end (4*a*) of the outlet tube (4); and a removable exhaust valve, the dispenser being characterized in that the cylinder (1) is provided with an internal lateral jacket (10) and in that the top edge of the jacket (10) is provided with a shoulder (11) under which a peripheral flange (22) formed on the bottom side edge of the endpiece (2) is engaged.

19. A dispenser according to claim 18 characterized in that the outside face (3*a*) of the piston (3) includes a bush (31) cooperating with the internal side wall of the cylinder (1) to define a peripheral space (12) in which the bottom side portion of the endpiece (2) is engaged.

20. A dispenser according to claim 18, characterized in that the endpiece (2) is constituted firstly by a dispenser head (20) provided with the internal evacuation duct (2*a*) communicating at its bottom end with the outlet tube (4) and extending, secondly, towards the cylinder (1) by a lateral skirt (21).

21. A dispenser according to claim 18, characterized in that it includes a removable cap (6) for covering the endpiece (2) and having an internal side wall which is provided with a vent-forming groove (9).

22. A dispenser according to claim 21, characterized in that the cap (6) is engaged telescopically on the top portion of the internal jacket (10), being flush with the outside wall (1*a*) of the cylinder (1).

23. A dispenser according to claim 18, characterized in that the axial duct (30) of the piston (3) projects into the cylinder (1) and the bottom (1*b*) of the cylinder is complementary in profile to the inside face (3*b*) of the piston (3) to ensure complete evacuation of the substance.

24. A dispenser according to claim 18 characterized in that the endpiece (2) is axially movable relative to the piston (3), being urged away therefrom by a spring (5) bearing against the outside face (3*a*) of the piston.

25. A dispenser according to claim 24 characterized in that the outlet tube (4) is then formed by a hollow rod slidably engaged in the axial duct (30) and having its bottom end (4*a*) projecting into the cylinder (1) regardless of the position of the endpiece (2).

26. A dispenser according to claim 24, characterized in that the bottom end (4*a*) of the outlet tube (4) is closed by a solid base (42) of larger section designed to bear in a sealed manner against the internal rim of the axial duct (30) when the endpiece (2) is being returned, thereby forming the exhaust valve.

27. A dispenser according to claim 24, characterized in that the admission orifice (40) opens out sideways at the bottom end (4*a*) of the outlet tube (4) on either side of its central axis.

28. A dispenser according to claim 18 characterized in that the axial duct (30) is terminated at its outer end by a hemispherical cap (30) pierced by a central ejection orifice (34) having elastically deformable edges designed to be closed in a closure position by an axial finger (23) secured to the endpiece (2) and forming the exhaust valve.

29. A dispenser according to claim 28, characterized n that the outlet tube (4) is engaged on the axial duct (30) and has its bottom edge (4*a*) bearing against the outside face (3*a*) of the piston (3).

30. A dispenser according to claim 18, characterized n that the outlet tube (4) is engaged in the axial duct (30) and bears via a peripheral shoulder (43) on the outside face (3*a*) of the piston (3).

31. A dispenser according to claim 30, characterized in that the internal evacuation duct (2*a*) of the endpiece (2) is provided with the exhaust valve (7) constituted by a rod (70) carrying firstly at its outer end a cup (71 ) whose lateral flank forms an elastically deformable peripheral lip (71*a*) and secondly, at its inner end, a spider (8) for fixing it in the evacuation duct (2*a*).

32. A dispenser according to claim 18, characterized in that the piston (3) is of substantially bell-shaped section with a peripheral lip (32) bearing in a sealed manner against the inside wall of the cylinder (1).

* * * * *